US006589393B1

(12) United States Patent
Meschenmoser

(10) Patent No.: US 6,589,393 B1
(45) Date of Patent: Jul. 8, 2003

(54) PRESS ARRANGEMENT AND PRESS ROLL FOR SUCH A PRESS ARRANGEMENT

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/528,155

(22) Filed: Mar. 17, 2000

(30) Foreign Application Priority Data

Mar. 19, 1999 (DE) ..... 199 12 495

(51) Int. Cl.[7] ..... D21F 3/00

(52) U.S. Cl. ..... 162/358.3; 162/358.1; 162/358.3; 162/360.2; 162/360.3; 100/163; 100/162; 100/152; 100/158

(58) Field of Search ..... 162/358.3, 358.1, 162/358.2, 360.2, 360.3; 100/163, 162, 152, 168, 153

(56) References Cited

U.S. PATENT DOCUMENTS 5,404,811 A * 4/1995 Schiel et al. ..... 100/163 R
5,843,282 A 12/1998 Schmitt et al.
6,029,365 A 2/2000 Schmitt et al.

FOREIGN PATENT DOCUMENTS

| | | |
|---|---|---|
| DE | 9204405 | 7/1992 |
| DE | 4445123 | 6/1996 |
| DE | 29702570 | 8/1997 |
| DE | 19609213 | 9/1997 |
| DE | 19709369 | 10/1997 |
| DE | 19822145 | 12/1999 |

* cited by examiner

*Primary Examiner*—Steven P. Griffin
*Assistant Examiner*—M. Halpern
(74) *Attorney, Agent, or Firm*—Greenblum & Bernstein, P.L.C.

(57) ABSTRACT

A press arrangement for treating a fibrous web, especially a paper or board web, comprises at least two press rolls to form at least one press nip. At least one press roll is mounted on at least one roll end by means of a floating bearing, whose bearing rings, arranged inside the bearing housing, can be displaced relative to each other in the direction of the roll axis.

15 Claims, 3 Drawing Sheets

PRESS ARRANGEMENT AND PRESS ROLL FOR SUCH A PRESS ARRANGEMENT

CROSS-REFERENCE TO RELATED APPLICATIONS

The present application claims priority under 35 U.S.C. §119 of German Patent Application No. 199 12 495.7, filed on Mar. 19, 1999, the disclosure of which is expressly incorporated by reference herein in its entirety.

BACKGROUND OF THE INVENTION

1. Field of the Invention

The invention relates to a press arrangement for treating a fibrous web, especially a paper or board web, having at least two press rolls to form at least one press nip. Moreover, it relates to a press roll.

2. Discussion of Background Information

In the shoe presses which have been customary utilized, the mating roll assigned to a respective shoe press roll on the operator's side and on the drive side is respectively mounted by way of a swinging roller bearing, the two swinging roller bearings being installed as locating bearings. The floating bearing function is implemented outside the bearing housing and the actual force flow on the operator's side by way of displaceable sliding bearings between the framing and the bearing housing. Inter alia, this entails the disadvantage that the relevant press module cannot be used sufficiently universally, which applies in particular to multi-roll presses. This is because the two opposite displaceable sliding bearings are always required at the sides on the bearing housing. Because of the unfavorable relationship between the distance between the guides and the length of the guides, there is the risk of tilting. This also applies to the usual conventional roll mountings having a displaceable bearing outer ring as a floating bearing, the displacement under pressing force being particularly critical here.

As a result of the aforementioned disadvantages, an uncontrolled axial bearing force may be produced, which shortens the service life of the roll mounting considerably and has a detrimental effect on the framing.

SUMMARY OF THE INVENTION

The object of the invention is to provide an improved press arrangement of the type mentioned at the beginning in which the abovementioned disadvantages are eliminated. In addition, the intention is to provide a press roll which is in particular suitable for such a press arrangement and can be used universally as a standard press module in the greatest possible number of press designs. The useful duration of the press roll bearings, in particular in the case of mating rolls on shoe presses, is to be increased and capable of being calculated. In particular, a virtually constant, preferably minimum axial force is also to be ensured. Such a press roll is also to be capable of being used, in particular, for so-called combipresses and multi-roll shoe presses.

With regard to the press arrangement, according to the invention this object is achieved by at least one press roll being mounted on at least one roll end by utilizing a floating bearing, whose bearing rings, arranged inside the bearing housing, can be displaced relative to each other in the direction of the roll axis. The two bearing rings of the floating bearing can preferably also be tilted relative to each other.

The relevant press roll can thus expand in any desired way without any sliding of a bearing outer ring or other guides under load being necessary to equalize the length. The relevant press roll can be used universally as a press module in an extremely wide range of press designs. The floating bearing function is fulfilled within the bearing housing. Thus, for example, the use for so-called combipresses can also readily be conceived of. An oblique installation position is possible without problems. New suspension points for the entire press module are also possible. Moreover, the respective bearing housings can be connected directly, permanently and compactly to the framing. The overall result is a more cost-effective construction.

In one embodiment the two bearing rings of the floating bearing can be tilted relative to each other, wherein the maximum angle of tilt can be about 0.5°, for example.

In a preferred practical embodiment of the press arrangement according to the invention, the two bearing rings are supported on all sides by bearing elements arranged between them. The bearing elements provided can, in particular, be bearing rollers.

A corresponding floating bearing is advantageously provided at least on the operator's side.

After the floating bearing function has been implemented within the bearing housing, the relevant bearing housing can then be permanently connected to the framing.

The press arrangement can comprise at least one shoe press, in this case advantageously at least one mating roll assigned to a respective shoe press roll being mounted on at least one roll end by utilizing a floating bearing.

The press roll bearing can be connected to the bearing housing of press rolls by positive connecting elements which permit displacement arising from a change in length of the rolls. The result is thus, in particular, flexural elasticity in the cross-machine direction.

The press roll according to the invention is defined in that it is provided at least one roll end with a floating bearing, whose bearing rings, arranged inside the bearing housing, can be displaced relative to each other in the direction of the roll axis.

The invention provides for a press arrangement for treating a fibrous web comprising, at least two press rolls arranged to form at least one nip, at least one of the at least two press rolls comprising at least one end which is mounted to a bearing housing via floating bearing, wherein the floating bearing comprises bearing rings which can move relative to each other in an axial direction of the at least one press roll. The at least one press roll may be floatingly mounted to the housing via the floating bearing. The fibrous web may comprise one of a paper web and a board web. The bearing rings may be tiltable relative to each other. A maximum angle of tilt may be about 0.5°. The bearing rings may be separated by bearing elements which are arranged between them. The bearing elements may comprise bearing rollers. The floating bearing may be provided on at least an operator's side of a press arrangement. The housing may be permanently connected to one of a framing and a swinging arm. The at least two press rolls may comprise at least one shoe press and at least one mating roll, the at least one mating roll is the at least one of the two press rolls having at least one end which is mounted to the bearing housing via the floating bearing. The press may further comprise at least one additional press roll arranged to form an additional press nip with one of the two press rolls, the at least two nips are formed by one of the press rolls, and wherein the one press roll is adjustably and moveably mounted via bearings to the bearing housing.

The invention also provides for a press roll for treating a fibrous web, comprising: a press roll rotatably mounted relative to a bearing housing via at least one floating bearing, wherein the floating bearing comprises bearing rings which can move relative to each other in an axial direction of the press roll. The bearing rings can tilt relative to each other. The tilt may be limited to a maximum angle of about 0.5°. The bearing rings may be separated by bearing elements which are arranged between them. The bearing elements may comprise bearing rollers.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for-purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
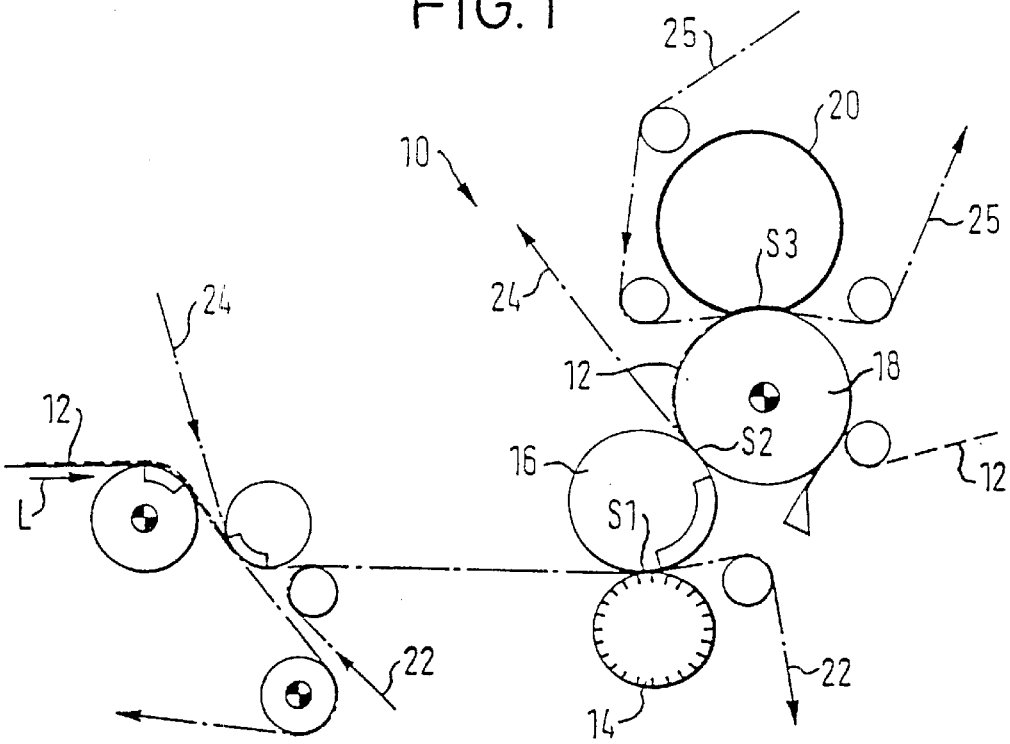
FIG. 1 shows a schematic illustration of an embodiment of a press arrangement having four press rolls.

FIG. 1 shows, in a purely schematic illustration, an exemplary embodiment of a press arrangement 10 for treating a fibrous web 12, which may be, in particular, a paper or board web.

The press arrangement comprises four press rolls 14, 16, 18 and 20, in which three press nips S1, S2 and S3 following one another in the web running direction L are formed, through which the fibrous web 12 is led.

The first press nip S1 formed between the first two press rolls 14 and 16 is double-felted. Here, the fibrous web 12 is led through the press nip S1 between a bottom felt 22 and a top felt 24. The second press nip S2 formed between the two central press rolls 16 and 18 is single-felted. Here, the fibrous web 12 is a led through this press nip S2 together with the top felt 24. The top press roll 20 is formed by a shoe press roll, which is assigned the central press roll 18 as mating roll. The third press nip S3 formed by this shoe press 18, 20 is single-felted. Here, the fibrous web 12 is led through this press nip S3 together with a top felt 25.

Figure 4:
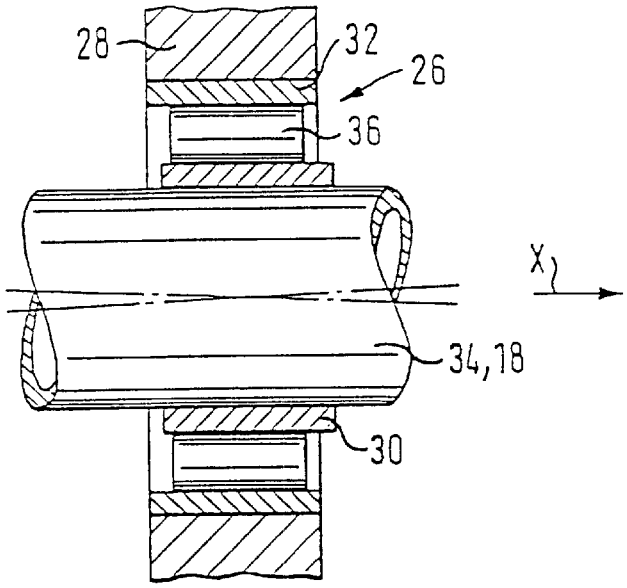
FIG. 4 shows a purely schematic cross-sectional illustration of a floating bearing.

The mating roll 18 assigned to the shoe press roll 20 is preferably mounted, on the roll end on the operator's side, by a floating bearing 26, which is illustrated purely schematically in FIG. 4 and whose bearing rings 30, 32, arranged inside the bearing housing 28, can be displaced relative to each other in the direction of the roll axis X.

As can be seen from FIG. 4, the two bearing rings 30, 32 of the floating bearing 26 can also be tilted relative to each other. In this case, the maximum angle of tilt can be about 0.5°, for example. In FIG. 4, the angular deflection is indicated greatly enlarged.

The inner bearing ring 30 is fitted to the relevant end of the mating roll 18. It may rest, for example, on a bearing or shaft journal 34 of this mating roll 18. The outer bearing ring 32 is fitted to the bearing housing 28. The two bearing rings 30, 32 are supported on all sides by bearing elements 36 arranged between them. In the present case, the bearing elements 36 provided are bearing rollers.

The bearing housing 28 can be permanently connected to the framing of the relevant paper machine.

Figure 2:
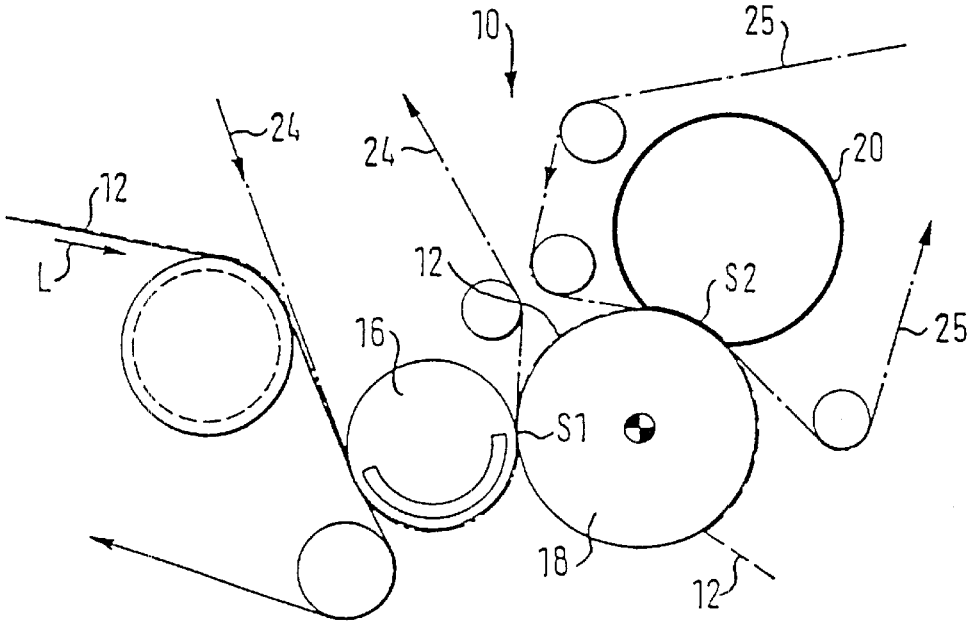
FIG. 2 shows a schematic illustration of an embodiment of a press arrangement having three press rolls.

FIG. 2 shows a purely schematic illustration of a further possible embodiment of a press arrangement, in which a press roll provided with a floating bearing in the above-described way can be used. This press arrangement, illustrated in FIG. 2, comprises only three press rolls 16, 18, 20, in which two press nips S1 and S2 are formed. The first press roll 16 in the present case is designed as a suction press roll. The top press roll 20 is again designed as a shoe press roll, which is assigned the central roll 18 as mating roll. The two press nips S1 and S2 are in each case single-felted, the fibrous web being led through the first press nip S1 together with a top felt 24 and through the second press nip S2 together with a top felt 25.

The mating roll 18 assigned to the shoe press roll 20 is again mounted, in the same way as the mating roll 18 of the press arrangement 10 according to FIG. 1, preferably on the operator's side, by utilizing a floating bearing 26, in particular of the type illustrated in FIG. 4.

The relevant press rolls 18 can therefore be mounted, at least on one side, in particular by way of a so-called CARB bearing, whose bearing rings 30, 32, arranged inside the bearing housing 28, can be displaced relative to each other in the direction of the roll axis X and, in addition, can preferably be tilted relative to each other (cf. FIG. 4).

Figure 3:
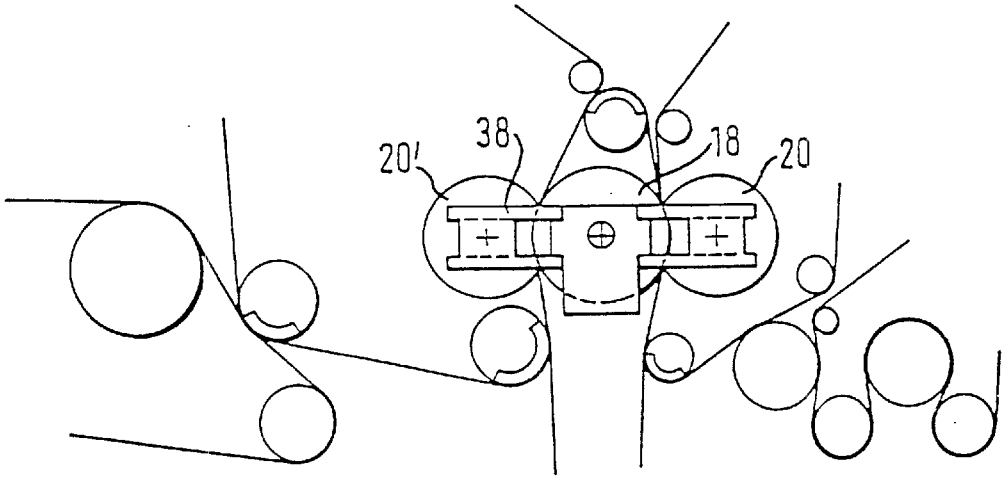
FIG. 3 shows a schematic illustration of a press section having three press rolls, two press rolls being arranged on the central press roll.

FIG. 3 shows a schematic illustration of a press section having three press rolls, two press rolls 20, 20' being arranged on the central press roll 18. In this case, the bearings of the press rolls 20, 20' can be connected to the bearing housing of the press roll 18 by positive connecting elements 38 which permit displacement arising from a change in length of the rolls 20, 20'.

Figure 5:
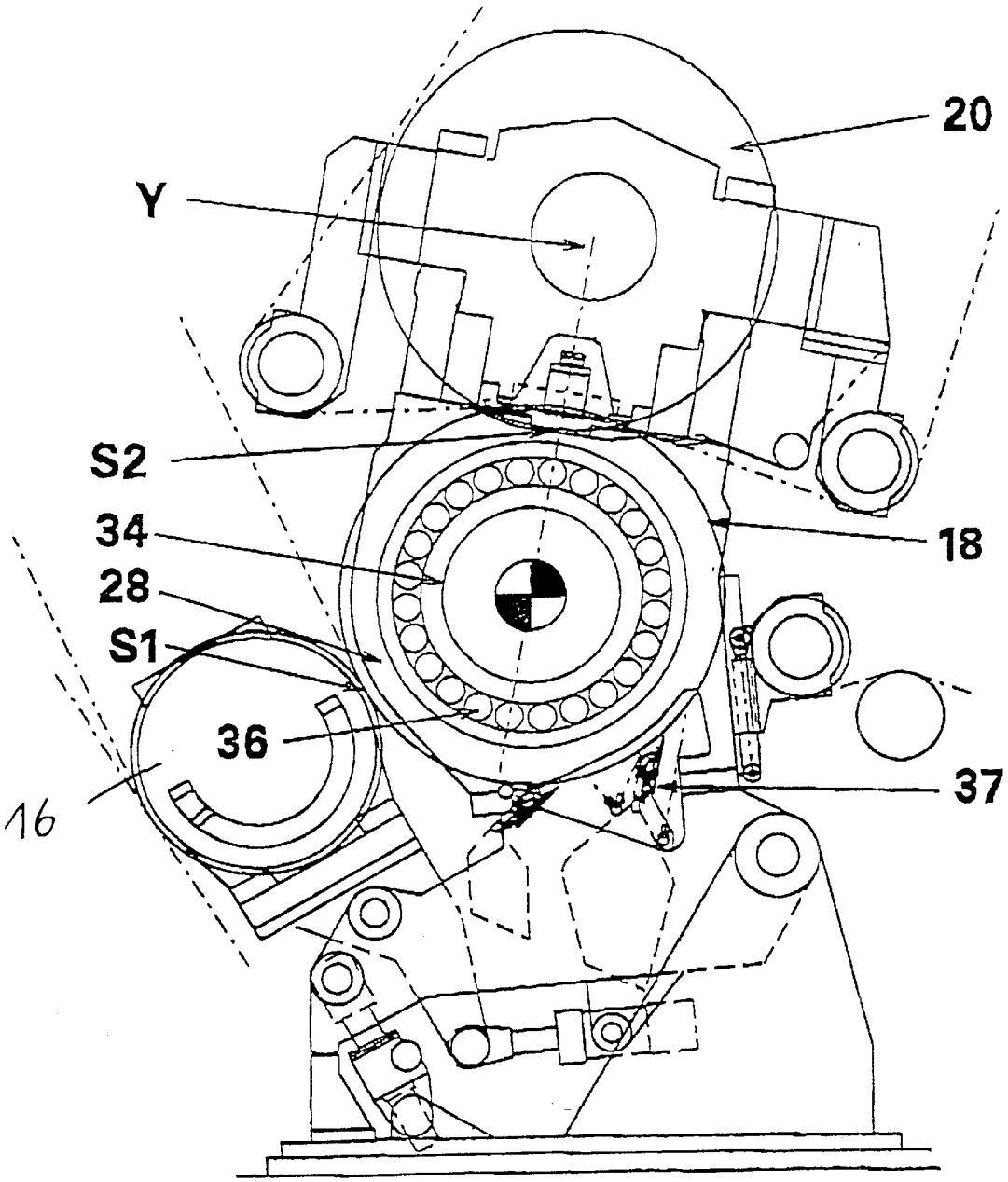
FIG. 5 shows a more detailed schematic illustration of an embodiment of a press arrangement having three press rolls, which reveals some advantages of the floating bearing used for the press rolls.

FIG. 5 shows a more detailed schematic illustration of an embodiment of a press arrangement having three press rolls 16, 18 and 20, which in the following text is used to indicate some advantages of the floating bearing or CARB bearing used for the press rolls. The basic construction of the present, purely exemplary press arrangement corresponds, at least substantially, to that of FIG. 1. The connecting line running through the axes of the two press rolls 18, 20 is designated by "Y".

Since the outer bearing ring 32 (cf. also FIG. 4) does not have to move in the case of the CARB bearing, as compared with conventional bearings, the wall thickness of the bearing housing 28 can be made relatively thin.

This results, inter alia, in the following further advantages:

That the bearing can be made larger in relation to the maximum predefined outer diameter of the bearing housing 28, which is associated, inter alia, with a higher load bearing capacity and, accordingly, a higher service life.

That the bearing housing 28 is more resilient, because of the thinner wall thickness at the circumference. Thus, as a result of the binding action, a number of bearing elements 36, formed by rollers for example, can absorb the force in the direction of the load. On the other hand, in the case of a conventional bearing, there would be a still greater displacement of the outer ring of the floating bearing, because of the elastic deformation.

As emerges from FIG. 5, the force distribution in the bearing can be predefined in an optimum manner by utilizing an appropriate arrangement of the press and the bearing points on the bearing housing 28.

That the clearance for the accessibility of the scraper device 37 is very important for a respective blade change and spray-pipe service, and can be configured in an optimum manner here, although the mounting may possibly be larger.

That the clearance required for a respective felt change in relation to the adjacent roll 16, provided here by way of example as a suction roll, is also optimal.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

| | |
|---|---|
| 10 | Press arrangement |
| 12 | Fibrous web |
| 14 | Press roll |
| 16 | Press roll |
| 18 | Press roll, mating roll |
| 20 | Press roll |
| 20' | Press roll |
| 22 | Bottom felt |
| 24 | Top felt |
| 25 | Top felt |
| 26 | Floating bearing |
| 28 | Bearing housing |
| 30 | Bearing ring |
| 32 | Bearing ring |
| 34 | Bearing or shaft journal |
| 37 | Scraper device |
| 36 | Bearing elements |
| L | Web running direction |
| S1 | Press nip |
| S2 | Press nip |
| S3 | Press nip |
| X | Roll axis |
| Y | Connecting line |

What is claimed:

1. A press arrangement for treating a fibrous web comprising:

at least two press rolls arranged to form at least one nip;

at least one of the at least two press rolls comprising at least one end which is mounted to a bearing housing via a floating bearing, wherein the floating bearing comprises bearing rings which can move relative to each other in an axial direction of the at least one press roll, and wherein the fibrous web travels through the at least one press nip.

2. The press arrangement of claim 1, wherein the at least one press roll is floatingly mounted to the housing via the floating bearing.

3. The press arrangement of claim 1, wherein the fibrous web comprises one of a paper web and a board web.

4. The press arrangement of claim 1, wherein the bearing rings can tilt relative to each other.

5. The press arrangement of claim 4, wherein a maximum angle of tilt is about 0.5°.

6. The press arrangement of claim 1, wherein the bearing rings are separated by bearing elements which are arranged between them.

7. The press arrangement of claim 6, wherein the bearing elements comprise bearing rollers.

8. The press arrangement of claim 1, wherein the floating bearing is provided on at least an operator's side of a press arrangement.

9. The press arrangement of claim 1, wherein the housing is permanently connected to one of a framing and a swinging arm.

10. The press arrangement of claim 1, wherein the at least two press rolls comprise at least one shoe press and at least one mating roll, the at least one mating roll is the at least one of the two press rolls having at least one end which is mounted to the bearing housing via the floating bearing.

11. The press arrangement of claim 1, further comprising at least one additional press roll arranged to form an additional press nip with one of the two press rolls, the at least two nips are formed by one of the press rolls, and wherein the one press roll is adjustably and moveably mounted via bearings to the bearing housing.

12. A press arrangement for treating a fibrous web comprising:

at least two press rolls arranged to form at least one press nip;

at least one of the at least two press rolls comprising at least one end which is mounted to a bearing housing via a floating bearing;

the bearing housing being fixed to one of a frame and a swinging arm; and the floating bearing comprising an inner bearing ring and an outer bearing ring, wherein each of the inner and outer bearing rings is movable relative to an axial direction of the at least one press roll, wherein the inner bearing ring is movable relative to an axial direction of the at least one press roll, and wherein the fibrous web travels through the at least one press nip.

13. The press arrangement of claim 12, wherein at least one of the inner and the outer bearing rings is tiltable.

14. A press arrangement for treating a fibrous web comprising:

at least two press rolls arranged to form at least one press nip;

at least one of the at least two press rolls comprising a shoe press roll;

another of the at least two press rolls comprising at least one end which is mounted to a bearing housing via a floating bearing; and the floating bearing comprising an inner bearing ring and an outer bearing ring, wherein each of the inner and outer bearing rings is movable relative to an axial direction of the at least one press roll, and wherein the fibrous web travels through the at least one press nip.

15. The press arrangement of claim 14, wherein at least one of the inner and the outer bearing rings is tiltable.

* * * * *